US009417549B2

(12) United States Patent
Soda

(10) Patent No.: US 9,417,549 B2
(45) Date of Patent: Aug. 16, 2016

(54) IMAGE FORMING APPARATUS

(71) Applicant: CANON KABUSHIKI KAISHA, Tokyo (JP)

(72) Inventor: Shota Soda, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/872,409

(22) Filed: Oct. 1, 2015

(65) Prior Publication Data

US 2016/0097989 A1 Apr. 7, 2016

(30) Foreign Application Priority Data

Oct. 3, 2014 (JP) ..... 2014-205221

(51) Int. Cl.
*G03G 15/02* (2006.01)

(52) U.S. Cl.
CPC ..... *G03G 15/0266* (2013.01)

(58) Field of Classification Search
CPC .... G03G 21/06; G03G 21/08; G03G 21/0094
See application file for complete search history.

(56) References Cited

U.S. PATENT DOCUMENTS 5,636,009 A * 6/1997 Honda ..... G03G 15/0266 399/176
8,447,213 B2 * 5/2013 Kim ..... G03G 15/0131 399/167
8,831,467 B2 * 9/2014 Higa ..... G03G 15/0131 399/96

FOREIGN PATENT DOCUMENTS

JP H08-16082 1/1996

* cited by examiner

*Primary Examiner* — Gregory H Curran
(74) *Attorney, Agent, or Firm* — Fitzpatrick, Cella, Harper & Scinto

(57) ABSTRACT

An image forming apparatus includes a rotatable photosensitive member; a charger for charging the photosensitive member by being supplied with a DC voltage; an image forming station for forming an image on the photosensitive member charged by the charger to form an electrostatic image; a current detector for detecting a DC current flowing to the charger when the charger is supplied with a DC voltage from the voltage source; an executing portion for executing pre-charging operation for charging by the charger the photosensitive member a which is rotating, after production of an image formation signal prior to image forming operation by the image forming station; and a controller for controlling an amount of rotation of the photosensitive member in the pre-charging operation on the basis of a DC current detected by the current detector during the pre-charging operation.

5 Claims, 7 Drawing Sheets

IMAGE FORMING APPARATUS

FIELD OF THE INVENTION AND RELATED ART

The present invention relates to an electrophotographic image forming apparatus.

An electrophotographic image forming apparatus forms an electrostatic latent image on an electrophotographic photosensitive member (photosensitive member), which is generally in the form of a drum, by charging the photosensitive member at a charging point, and exposing the charged portion of the photosensitive member, based on the information of an image to be formed, at an exposing point. It has been known that the potential level to which the photosensitive member is charged during the first rotation of the photosensitive member immediately after the starting of the process for charging the photosensitive member (charging step), is sometimes lower than that during the second rotation, and thereafter, of the photosensitive member. In a case where a part of an electrostatic latent image is formed, by an exposing process (exposing step), across the portion of the peripheral surface of the photosensitive member, which was charged during the first rotation of the photosensitive member, being therefore lower in potential level than the portion of the peripheral surface of the photosensitive member, which was charged during the second rotation, and thereafter, of the photosensitive member, whereas another part of the electrostatic latent image is formed across the portion of the peripheral surface of the photosensitive member, which was charged during the second rotation, and thereafter, of the photosensitive member, the first portion of the latent image is lower in lower in potential level than the second portion, for the following reason.

One of the widely known methods for charging a photosensitive member is the so-called contact charging method, which places a rotational charging member such as a charge roller which is rotated by the rotation of the photosensitive member, in contact with the photosensitive member. Generally speaking, in a case where the peripheral surface of a photosensitive member, which is 0 V, or roughly 0 V, in potential level is charged once by the contact charging method, it is unlikely for the potential level of the peripheral surface of the photosensitive member to converge to a preset desired level. The difference between the potential level to which the photosensitive member is charged during the first rotation of the photosensitive member, and that during the second rotation of the photosensitive member results in the formation of an image which is nonuniform in density. Further, it has been known that as an electrostatic latent image is developed with the use of the reversal developing method, a given point of the electrostatic latent image, which is lower in potential level, will yield a point of a developed image (visible image) which is higher in density.

In the past, therefore, in order to ensure that a photosensitive member begins to be exposed after the portion of the peripheral surface of the photosensitive member, which has been made stable in surface potential level by the second rotation of the photosensitive member after the starting of the charging of the photosensitive member, arrives at the exposing point, an image forming apparatus is made to perform a preparatory operation (warm-up operation) (Japanese Laid-open Patent Application H08-16082). According to this charging method, the preparatory operation requires at least a length of time which is equivalent to the sum of the circumference of the photosensitive member and the distance from the charging point or the exposing point.

In recent years, however, a DC-based charging method, which uses only direct current voltage (DC voltage), has been sometimes used to reduce an image forming apparatus in cost, and also, to reduce an image forming apparatus in the size of the space the apparatus occupies. In a case where this DC-based charging method is employed, it sometimes occurs that as a charge roller increases in electrical resistance in an environment which is low in temperature as well as humidity, the surface potential level of the photosensitive member sometimes fails to converge to a preset desired level even during the second rotation of the photosensitive member after the photosensitive member begins to be charged. Thus, the difference between the potential level to which the peripheral surface of the photosensitive drum is charged during the second rotation of the photosensitive member, and that during the third rotation, sometimes manifests as the nonuniformity (anomaly) in image density.

As for the solution to the above-described problem, it is possible to place a charge removal exposing device such as an LED, immediately before the aforementioned point at which the photosensitive member begins to be charged, to prevent the problem that the peripheral surface of the photosensitive member remains nonuniform in potential level even after the second rotation of the photosensitive member. However, providing an image forming apparatus with a charge removal exposing device such as the above-described one is sometimes contrary to the effort to reduce an image forming apparatus in cost and size.

As for the countermeasure for the above-described problem, it is possible to begin to expose the photosensitive member after the portion of the peripheral surface of the photosensitive drum, which has become stable in potential level during the third rotation of the photosensitive drum, after the starting of the charging of the photosensitive drum, arrives at the exposing point. In this case, however, the preparatory operation requires at least a length of time which is proportional to the sum of twice the circumference of the photosensitive drum and the distance from the point at which the photosensitive drum begins to be charged, and the point at which the photosensitive member begins to be exposed. It is possible, however, that the surface potential level of the photosensitive member reaches the desired potential level during the second rotation of the photosensitive member 1 after the starting of the process for charging the photosensitive member, although it depends on the history of the usage of each image forming apparatus. Therefore, always starting the exposing process during the third rotation of the photosensitive drum as described above sometimes wastes time.

SUMMARY OF THE INVENTION

Thus, the primary object of the present invention is to provide an electrophotographic image forming apparatus which is substantially lower in the level of nonuniformity (anomaly) in terms of the density of an image it forms than any conventional electrophotographic image forming apparatus.

According to an aspect of the present invention, there is provided an image forming apparatus comprising a rotatable photosensitive member; a charging member configured to charge said photosensitive member by being supplied with a DC voltage; an image forming station configured to form an image on said photosensitive member charged by said charging member to form an electrostatic image; a current detector configured to detect a DC current flowing to said charging member when said charging member is supplied with a DC voltage from said voltage source; an executing portion configured to execute pre-charging operation for charging by said charging member said photosensitive member a which is rotating, after production of an image formation signal prior to image forming operation by said image forming station; and a controller configured to control an amount of rotation of said photosensitive member in the pre-charging operation on the basis of a DC current detected by said current detector during the pre-charging operation.

Further features of the present invention will become apparent from the following description of exemplary embodiments with reference to the attached drawings.

DESCRIPTION OF THE EMBODIMENTS

Hereinafter, image forming apparatuses in accordance with the present invention are described in detail with reference to appended drawings.

Embodiment 1

1. Overall Structure, and Operation, of Image Forming Apparatus

Figure 1:
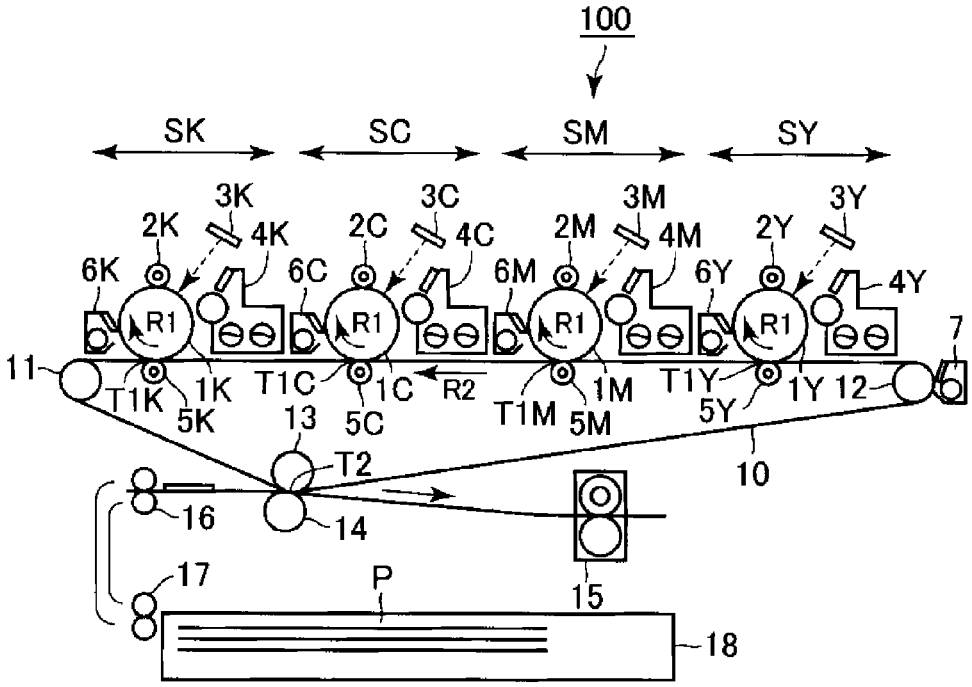
FIG. 1 is a schematic sectional view of the image forming apparatus in the first embodiment of the present invention.

FIG. 1 is a schematic sectional view of the image forming apparatus 100 in the first embodiment of the present invention. The image forming apparatus 100 in this embodiment is a laser beam printer of the so-called tandem type, which is capable of forming a full-color image with the use of an electrophotographic method, and which employs an intermediary transferring member.

Figure 2:
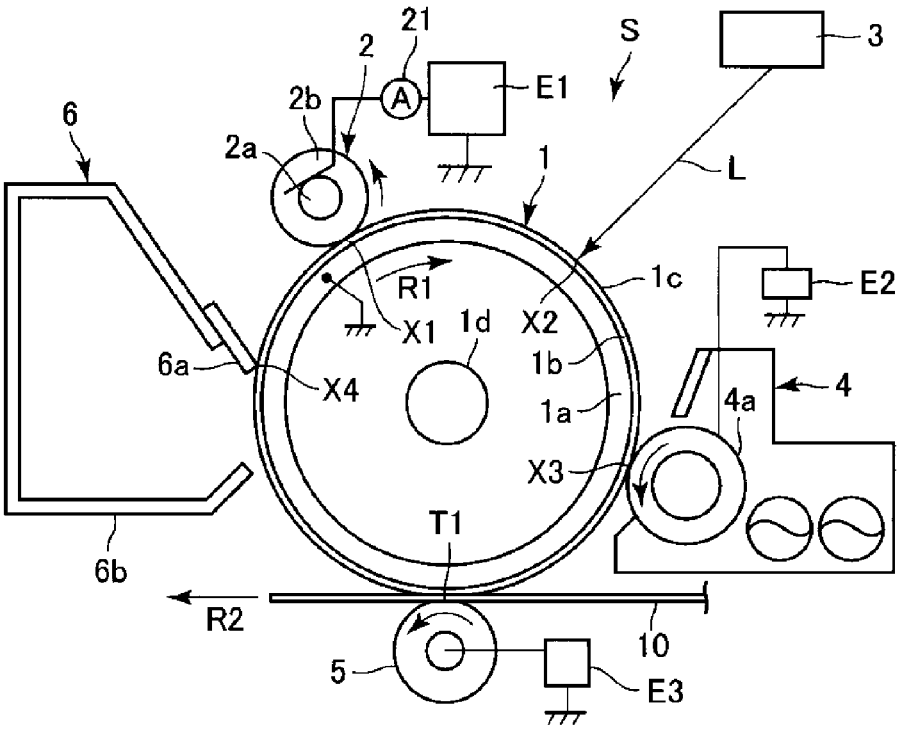
FIG. 2 is a schematic sectional view of an image forming section of the image forming apparatus shown in FIG. 1.

The image forming apparatus 100 has multiple image forming sections. More specifically, it has the first, second, third, and fourth image forming sections SY, SM, SC and SK, which form yellow (Y), magenta (M), cyan (C) and black (K) toner images, respectively. In this embodiment, the image forming sections SY, SM, SC and SK are practically the same in structure and operation, although they are different in the color of the toner they use. Therefore, the suffixes Y, M, C and K which indicate the colors of the images they form are not shown, unless they need to be specifically noted. That is, they will be described together. FIG. 2 is a schematic sectional view of one of the four image forming sections. It shows the structure of the image forming section S in more detail than FIG. 1.

The image forming section S has a photosensitive member 1 (photosensitive drum), as an image bearing member, which is in the form of a rotatable drum (cylindrical drum). The photosensitive member 1 is rotationally driven in the direction indicated by an arrow mark R1 in the drawings. There are disposed in the adjacencies of the peripheral surface of the photosensitive member 1, the following processing devices which make up the image forming section S and are sequentially disposed in the rotational direction of the photosensitive member 1. The first one is a charge roller 2, as a charging means, which is a charging member which is in the form of a roller. The next one is an exposing device 3 (laser scanner) as an exposing means. The next one is a developing device 4 as a developing means. The next one is a primary transfer roller 5, as the first transferring means, which is a first transferring member which is in the form of a roller. The next one is a drum cleaning device as a cleaning means for cleaning the photosensitive member 1.

Further, the image forming apparatus 100 has an intermediary transfer belt 10 which is an intermediary transferring member which is disposed in a manner to oppose the photosensitive member 1 of the image forming section S. In this embodiment, the intermediary transfer belt 10 is an endless belt. The intermediary transfer belt 10 is suspended and kept tensioned by multiple suspending members, more specifically, a tension roller 11, a driving roller 12, and a belt backing roller 13 which opposes a secondary transfer roller 14. The intermediary transfer belt 10 is rotationally driven by the driving roller 12 in the direction indicated by an arrow mark R2 in the drawings. Further, there are disposed primary transfer rollers 5Y, 5M, 5C and 5K in the inward side of the loop which the intermediary transfer belt 10 forms, in such a manner that they oppose the photosensitive members 1Y, 1M, 1C and 1K, respectively. The primary transfer roller 5 is pressed toward the photosensitive member 1, with the presence of the intermediary transfer belt 10 between itself and intermediary transfer belt 10, whereby it forms a primary transferring section T1 (primary transfer nip), which is the area of contact between the intermediary transfer belt 10 and photosensitive member 1. Further, there is disposed a secondary transfer roller 14, on the outward side of the loop which the intermediary transfer belt 10 forms, in such a manner that it opposes the belt backing roller 13. The secondary transfer roller 14 is a transferring member as the secondary transferring means. It is in the form of a roller. It is pressed toward the belt backing roller 13, with the presence of the intermediary transfer belt 10 between itself and roller 13, whereby it forms a secondary transferring section T2 (secondary transfer nip) which is the area of contact between the intermediary transfer belt 10 and secondary transfer roller 14. There is also disposed a belt cleaning device 7, as a means for cleaning the intermediary transfer belt 10, on the outward side of the loop which the intermediary transfer belt 10 forms, in such a manner that it opposes the driving roller 12.

In an image forming operation, the photosensitive member 1 is rotationally driven by an unshown driving device at a preset peripheral velocity (process speed) in the direction indicated by the arrow mark R1 in the drawings. As the photosensitive member 1 is rotationally driven, the peripheral surface of the photosensitive member 1 is uniformly charged by the charge roller 2 to preset polarity (negative in this embodiment) and potential level. During this process, a preset charge voltage is applied to the charge roller 2 from a charge voltage power source E1 as a voltage applying means. Upon the uniformly charged portion of the peripheral surface of the photosensitive member 1, a beam of laser light is projected, while being modulated by the image information, from the exposing device 3. Consequently, an electrostatic latent image (electrostatic image) is effected on the peripheral surface of the photosensitive member 1. The electrostatic latent image on the photosensitive member 1 is effected because as various points of the uniformly charged portion of the peripheral surface of the photosensitive member 1 are exposed to the beam L of laser light, their potential level reduces to V1 (roughly −100 V), whereas the potential level of the unexposed points of the peripheral surface of the photosensitive member 1, remains unchanged in potential level at Vd (roughly −700 V). The electrostatic latent image on the photosensitive member 1 is developed into a visible image (image formed of toner, which hereafter will be referred to as "toner image") by the developing device 4 which uses toner as developer. In this embodiment, the electrostatic latent image on the photosensitive member 1 is reversely developed into a toner image. That is, toner particles, the polarity of which is the same as that to which the photosensitive member 1 is charged, are adhered to the points of the peripheral surface of the photosensitive member 1, which were exposed after being uniformly charged. During this process of developing the latent image, development voltage (development bias), the polarity of which is the same as that to which the photosensitive member 1 was charged, is applied to the development roller 4*a*, as a developer bearing member, with which the developing device 4 is provided.

The toner image formed on the photosensitive member 1 is transferred (primary transfer) in the primary transferring section N1 by the function of the primary transfer roller 5 onto the intermediary transfer belt 10 which is being rotationally driven in the direction indicated by the arrow mark R2 in the drawings by an unshown driving device, in synchronism with the rotation of the photosensitive member 1. During this primary transfer, the primary transfer voltage (primary transfer bias), the polarity of which is opposite (positive in this embodiment) from that (normal polarity) to which toner is charged for development, is applied to the primary transfer roller 5 from a primary transfer voltage source E3 as a voltage applying means. For example, during the formation of a full-color image, the four toner images, which are formed in the image forming sections SY, SM, SC, and SK, one for one, and which are different in color, are transferred (primary transfer) onto the intermediary transfer belt 10 in the primary transferring sections T1, in such a manner that they are sequentially layered upon the intermediary transfer belt 10. Consequently, a full-color image is effected on the intermediary transfer belt 10 by the four monochromatic toner images which are different in color.

After the primary transfer of the toner images, the toner (primary transfer residual toner) remaining on the peripheral surface of each photosensitive member 1 is removed and recovered by the drum cleaning device 6. More concretely, the drum cleaning device 6 scrapes the primary transfer residual toner from the peripheral surface of the rotating photosensitive member 1 by its cleaning blade 6*a*, and recovers the removed toner into its toner recovery container 6*b*.

In synchronism with the progression of the primary transfer of the toner images onto the intermediary transfer belt 10, a sheet P of recording medium such as recording paper is fed into the main assembly of the image forming apparatus 100 by a feeding-conveying roller 17 from a sheet cassette 18. Then, each sheet P is delivered to the secondary transferring section T2 by a pair of registration rollers 16. In the secondary transferring section T2, the toner images on the intermediary transfer belt 10 are transferred (secondary transfer) onto the sheet P by the function of the secondary transfer roller 14. During this process, secondary transfer voltage (secondary transfer bias), the polarity of which is opposite from that to which toner is charged for development, is applied to the secondary transfer roller 14 from an unshown secondary transfer voltage source as a voltage applying means. During the formation of a full-color image, the four monochromatic toner images on the intermediary transfer belt 10, which are different in color, are transferred together (secondary transfer) onto the sheet P of recording medium.

After the transfer of the toner images onto the sheet P of transfer medium, the sheet P is separated from the intermediary transfer belt 10, and is conveyed to a fixing device cleaner 15 as a fixing means, in which the sheet P is heated and pressed. Thus, the toner images are fixed to the sheet P. Thereafter, the sheet P is discharged from the main assembly of the image forming apparatus 100.

Further, the toner (secondary transfer residual toner) remaining on the surface of the intermediary transfer belt 10 after the completion of the secondary transfer of the toner images is removed from the surface of the intermediary transfer belt 10, and recovered, by the belt cleaning device 7.

2. Detailed Structure of Image Forming Section

In this embodiment, the photosensitive member 1 which is an image bearing member is an organic photosensitive member which has an electrically conductive supporting member 1*a*, and two layers, more specifically, an organic photosensitive layer 1*b* and a surface protection layer 1*c*, which are layered in the listed order, on the peripheral surface of the electrically conductive supporting member 1*a*. There are contained fluorine resin particles in the surface protection layer 1*c*. The electrically conductive supporting member 1*a* of the photosensitive member 1 in this embodiment is an aluminum cylinder which is 1 mm in thickness, and on the peripheral surface of which the photosensitive layer 1*b* and protection layer 1*c* are layered. The photosensitive member 1 is 30 mm in external diameter. Further, the photosensitive member 1 rotates at a preset peripheral velocity about its rotational axis 1*d* in the direction indicated by the arrow mark R1 in the drawing, by receiving driving force from the motor of the driving device.

In this embodiment, the charge roller 2, as a charging member which is a rotational member, is disposed in contact with the photosensitive member photosensitive member 1. It uniformly charges the peripheral surface of the photosensitive member 1 to preset polarity (negative in this embodiment) and preset potential level. The charge roller 2 has an electrically conductive core 2*a* (metallic core), which functions as the rotational axle of the charge roller 2, and an elastic layer 2*b* formed around the metallic core metallic core 2*a*. As the material for the metallic core 2*a*, metallic substances such as iron, copper, stainless steel, and aluminum can be used. In this embodiment, aluminum was used. By the way, in order to prevent the core member 2*a* from rusting and/or being scarred, the core member 2*a* may be plated, provided that plating does not make the core member 2*a* electrically non-conductive.

In consideration of the fact that as the charge roller 2 is pressed upon the photosensitive member 1, the elastic layer 2*b* of the charge roller 2 is deformed, the elastic layer 2*b* of the charge roller 2, is desired to be formed in such a shape that in terms of its lengthwise direction, its center portion is thicker than the end portions; the charge roller 2 is polished so that it crowns, in terms of sectional view at a plane which coincides with the axial line of the charge roller 2, because the lengthwise ends of the charge roller 2 are subjected to a preset amount of pressure applied toward the photosensitive member 1 by a pressure application mechanism (unshown). That is, because the contact pressure between the charge roller 2 and photosensitive member 1 is likely to be smaller across the center portion of the area of contact between the charge roller 2 and photosensitive member 1 than across the lengthwise end portions, the charge roller 2 is shaped as described above. Further, as the material for the elastic layer 2*b* of the charge roller 2, an electrically conductive substance, which has been adjusted in electrical resistance by the dispersion of electrically conductive agent into the substance to make the substance no more than $1\times10^5$ Ω·cm in volume resistivity, can be used. As the electrically conductive agent, carbon black, graphite, electrically conductive metallic oxides, or the like, which conducts electrons, or alkaline metallic salt, or the like which conducts ions, can be used. Further, as the elastic material, EPDM (ethylenepropylenediene rubber), natural rubber, SUB (styrenebutadiene rubber), silicone rubber, urethane rubber, epichrorohydrin rubber, IR (isoprene rubber), BR (butadiene rubber), NBR (nitrile rubber), CR (chloroprene rubber, and the like synthetic rubber, polyamide resin, polyurethane resin, silicone resin, can be used.

In particular, in this embodiment, the core 2*a* of the charge roller 2 is 8 mm in diameter. The elastic layer 2*b* was adjusted in volume resistivity by the addition of electrically conductive agent to the material for the elastic layer 2*b*; it is $1\times10^5$ Ωcm in volume resistivity. It is 14 mm in external diameter. As the electrically conductive agent, one of the electrically conductive substances which conduct ions was used.

To the core member 2*a* of the charge roller 2 is in connection to a charge voltage power source E1 which is for applying charge bias to the charge roller 2, and an ammeter 21 (electric current detection circuit) for measuring the amount by which electric current flows from the charge voltage power source E1 to the charge roller 2 while the charge bias is applied. In this embodiment, the charge voltage power source E1 applies to the charge roller 2, direct current voltage (DC voltage), for example, −1300 V of DC voltage, as the charge bias. With the application of −1300 V of DC voltage, the photosensitive member 1 is uniformly charged to a potential level of Vd, for example, −700 V. Further, the ammeter 21, as an electrical current detecting means, which is an electric current detecting section, detects (monitors) the direct current component (amount by which direct current flows) which flows between the charge roller 2 and photosensitive member 1 as the charge bias is applied to the charge roller 2 from the charge voltage power source E1. The ammeter 21 is capable of detecting the amount by which the DC component flows per unit length of time (that is, relationship between elapsed length of time and amount of direct current). The unit length of time (chronological resolution) is no more than 5 msec, preferably, no more than 1 msec.

Further, in this embodiment, the charge roller 2 is rotatably supported, with the lengthwise ends of its core member 2*a* being supported by a pair of bearings (unshown), one for one. The above-mentioned pair of bearings are pressed toward the photosensitive member 1 by a pressure application mechanism (unshown) so that the charge roller 2 is pressed upon the photosensitive member 1 in such a manner that a preset amount of pressure is generated between the charge roller 2 and photosensitive member 1. Thus, the charge roller 2 is rotated by the rotation of the photosensitive member 1. By the way, regarding the method for driving the charge roller 2, the charge roller 2 may be driven with the use of a motor gear.

In terms of the rotational direction (circumferential direction) of the photosensitive member 1, the point at which the peripheral surface of the photosensitive member 1 is charged by the charge roller 2 is referred to as a charging position X2, hereafter. By the way, in the case of a contact charging method which uses the charge roller 2, electrical discharge occurs in at least one of the upstream and downstream gaps, in terms of the moving direction of the peripheral surface of the photosensitive member 1, which are next to the area of contact between the charge roller 2 and photosensitive member 1. It is by this electrical discharge that the peripheral surface of the photosensitive member 1 is charged. However, from the standpoint of making it easier to understand the control in this embodiment, there is no problem even if it is assumed here that the peripheral surface of the photosensitive member 1 is charged in the area of contact between the charge roller 2 and photosensitive member 1. In terms of the rotational direction of the photosensitive member 1, it is at an exposing position X2 that the peripheral surface of the photosensitive member 1 is exposed to the beam of laser light emitted by the exposing device 3. Also in terms of the rotational direction of the photosensitive member 1, a development position X3 is the area in which the development roller 4*a* of the developing device 4 opposes the photosensitive member 1, and the above-described primary transferring section T1 corresponds to the transfer point. The area of contact between the photosensitive member 1 and cleaning blade 6*a* is a cleaning position X4.

In this embodiment, the charge voltage power source E1 applies to the charge roller 2, such voltage that comprises only the DC component for charging the photosensitive member 1 (DC-based charging method). Further, in this embodiment, the image forming apparatus 100 does not have a light source for projecting light upon the photosensitive member 1 at a position other than the exposure position for the exposing device 3 (it does not have exposing device for discharging photosensitive member 1).

3. Pre-Rotation Process (Preparatory Operation, Pre-Charging Operation)

The image forming apparatus 100 is started by an image formation start command. It performs an image formation sequence (job) for forming an image on a single or multiple sheets P of transfer medium, and outputs the sheets P. Generally speaking, each image formation sequence comprises an image formation process (printing process), a pre-rotation process, sheet interval(s) (transfer medium interval(s)) which occurs in a case where images are formed on multiple sheets P of transfer medium, and post-rotation process. The image formation process corresponds to a period in which an electrostatic latent image is formed on the photosensitive member 1; a toner image is formed; the toner image is transferred (primary transfer); and the toner image is transferred (secondary transfer). The pre-rotation process corresponds to a period in which the image forming apparatus 100 is being prepared for an actual image forming operation, prior to the starting of the actual image forming operation. The sheet interval corresponds to a period which occurs between two consecutively conveyed sheets P of transfer medium in an image forming operation for forming images on multiple sheets P of transfer medium. The post-rotation process corresponds to a period in which the image forming apparatus 100 is made to prepare for the next round of image formation after the completion of the image formation process.

In particular, in this embodiment, "pre-rotation" means a preparatory operation (warm-up operation, pre-charging operation) for continuously rotating the photosensitive member 1 until the peripheral surface of the photosensitive member 1 becomes uniformly charged in such a manner that the potential level of the peripheral surface of the photosensitive member 1 converges to a preset level, after the photosensitive member 1 begins to be charged. More concretely, in this embodiment, "pre-rotation" corresponds to the period between when the photosensitive member 1 begins to be charged and when the peripheral surface of the photosensitive member 1 begins to be exposed based on image information, by the exposing device 3. Also in this embodiment, "image formation" corresponds to the period in which the peripheral surface of the photosensitive member 1 is exposed (exposure process), based on image information, by the exposing device 3 after the ending of the "pre-rotation".

As toner is electrically adhered to various points of the electrostatic latent image formed on the peripheral surface of the photosensitive member 1 by the exposing process, by an amount determined by the potential level of the various points, a toner image is formed on the peripheral surface of the photosensitive member 1. Then, the toner image is transferred onto the intermediary transfer belt 10. Prior to the starting of the above-described process of adhering toner to the peripheral surface of the photosensitive member 1, the pre-rotation process is carried out, which is the preparatory operation for charging the photosensitive member 1, while rotating the photosensitive member 1, prior to the image formation. As described above, it occurs sometimes that in order to ensure that when the peripheral surface of the photosensitive member 1 is charged by the charge roller 2, the photosensitive member 1 is uniformly charged in such a manner that the potential level of the peripheral surface of the photosensitive member 1 converges to the preset level, the photosensitive member 1 has to be rotated multiple times during the preparatory operation in which the photosensitive member 1 is charged, while being rotated, prior to the starting of the image formation process. The number of times the photosensitive member 1 has to be rotated in order to ensure that the peripheral surface of the photosensitive member 1 is uniformly charged to the preset level (how long, in terms of number of rotations, photosensitive member 1 has to be rotated) is affected by the condition of the charge roller 2, the environment in which the image forming apparatus 100 is used, and/or the like factors.

One of the characteristics of the charge roller 2 in this embodiment, which is of the "ion conduction type" is that it is smaller in the change in electrical resistance, which is attributable to the cumulative length of time (number of times) it has been used, than a charge roller of the "electron conduction type", but, it is greater in the changes in electrical resistance, which is attributable to the change which occurs to the environment in which it is used, than a charge roller of the "electron conduction type". In an environment which is low in both temperature and humidity, the charge roller 2 becomes higher in electrical resistance than in an environment which is high in both temperature and humidity. Thus, in an environment which is low in both temperature and humidity (low humidity environment), the charge roller 2 is relatively high in electrical resistance, and therefore, greater in the amount by which the voltage between the core member 2*a* and the peripheral surface of the charge roller 2 reduces. Thus, in the low humidity environment, the charge roller 2 is likely to be inferior in terms of the convergence of the potential level of the peripheral surface of the photosensitive member 1 to a preset value. Therefore, as described above, in a case where the number of times the photosensitive member 1 is to be rotated during the pre-rotation process is less than the number of times the photosensitive member 1 is to be rotated to become optimally charged, the potential level to which the peripheral surface of the photosensitive member is charged during the second rotation of the photosensitive member becomes different from that during the third rotation of the photosensitive member. This difference manifests as anomaly (nonuniformity) in image density. On the other hand, in a case where the number of times the photosensitive member 1 is rotated in the pre-rotation process is greater than the number of times the photosensitive member 1 is to be rotated to become optimally charged, a certain amount of time is wasted by the pre-rotation process.

Figure 3:
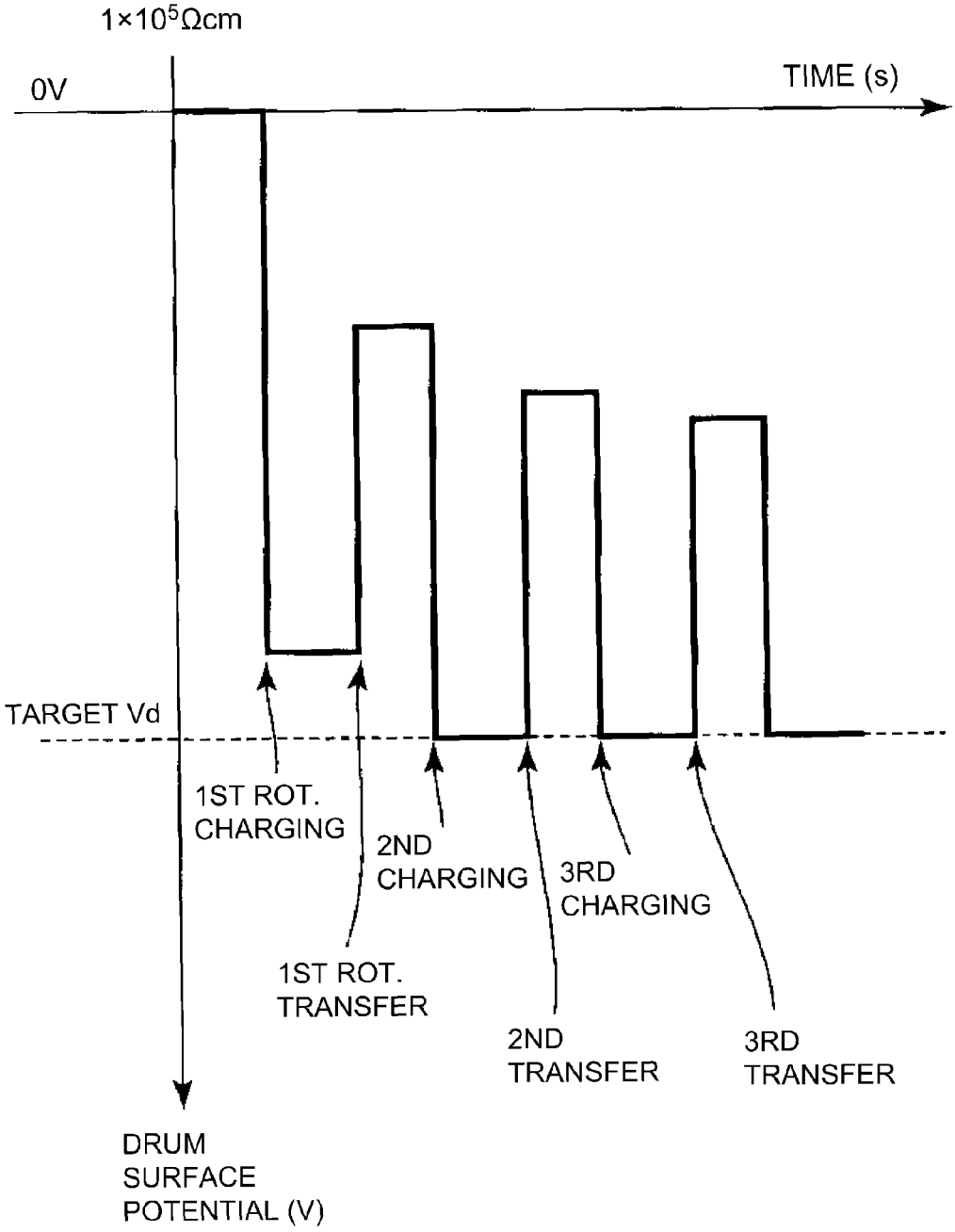
FIG. 3 is a schematic drawing for showing the differences among the potential levels to which the peripheral surface of the photosensitive member is charged in the first, second, and third rotations of the photosensitive drum in the normal environment.
Figure 9:
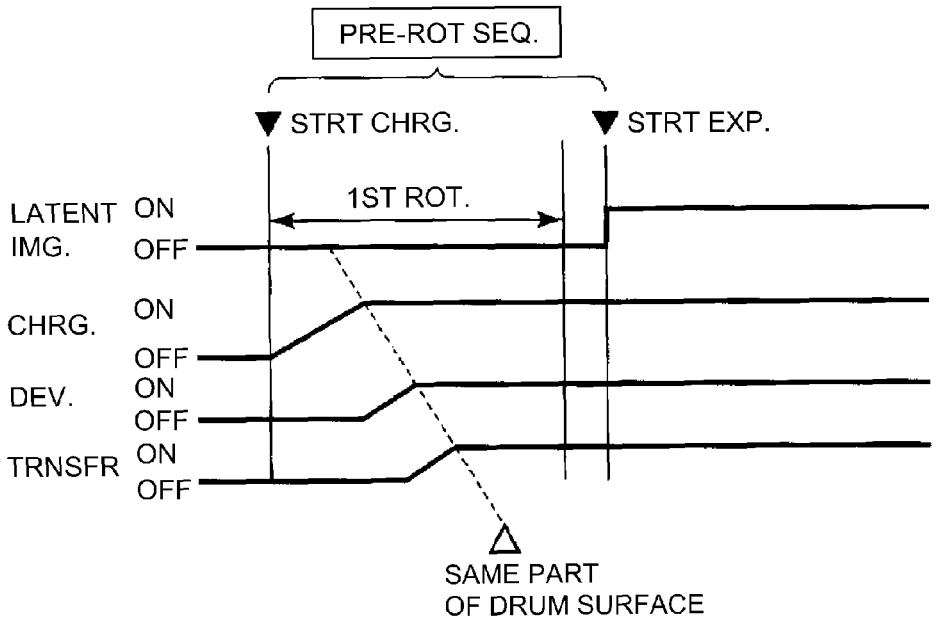
FIG. 9 is a timing chart of the normal pre-rotation sequence.

FIG. 3 schematically shows the changes which occurred to the surface potential level of the photosensitive member 1 during the pre-rotation process when the electrical resistance of the charge roller 2 was $1\times10^5$ Ω·cm. During the first rotation of the photosensitive member 1, the surface potential level of the photosensitive member 1 did not converge to a target level (intended Vd). However, it was uniformly charged to the target level during the second rotation of the photosensitive member 1. In this case, therefore, the exposure process has only to be started as the portion of the peripheral surface of the photosensitive member 1, which has become stable in surface potential at the target level during the second rotation of the photosensitive member 1, reaches the exposing position X2. Thus, the shortest length of time necessary for the pre-rotation process to properly charge the peripheral surface of the photosensitive member 1 is equivalent to the sum of the circumference of the photosensitive member 1 and the distance from the charging position X1 to the exposing position X2 (FIG. 9, which will be described later).

Figure 4:
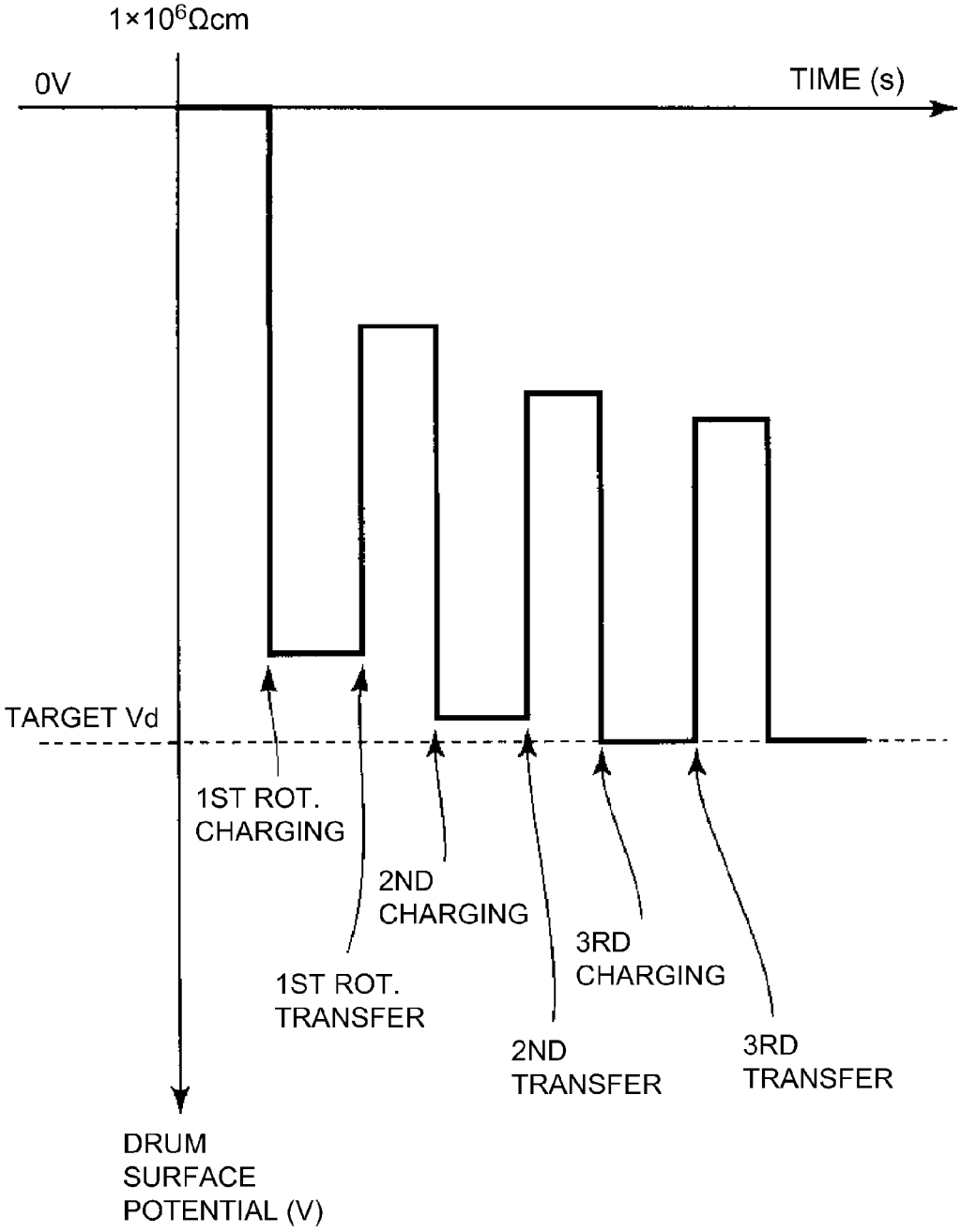
FIG. 4 is a schematic drawing for showing the differences among the potential levels to which the peripheral surface of the photosensitive member is charged in the first, second and third rotations of the photosensitive drum in a low humidity environment.
Figure 10:
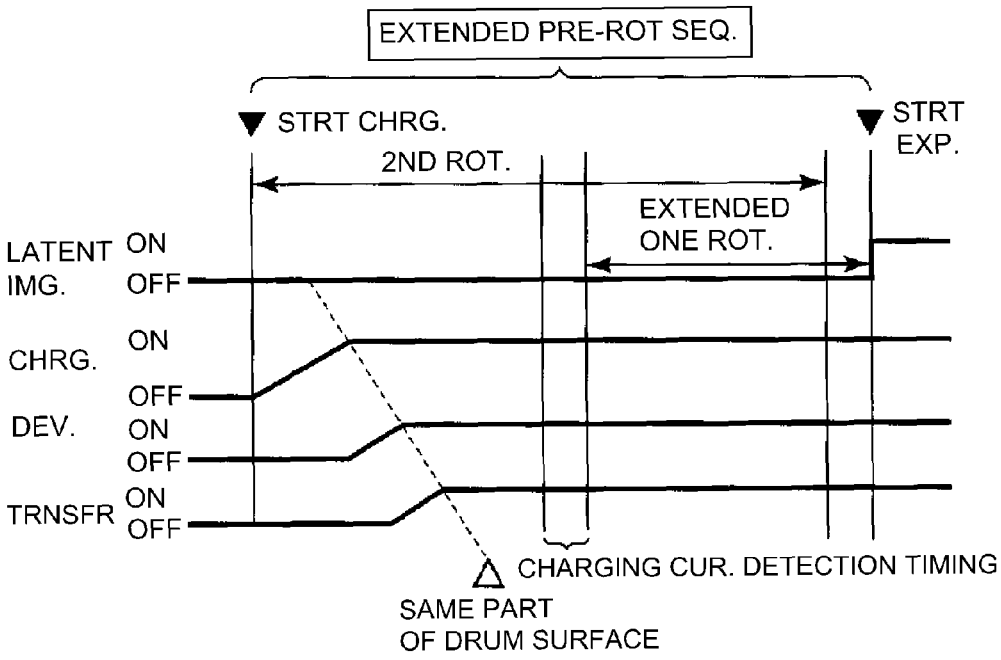
FIG. 10 is a timing chart of the extended pre-rotation sequence.

FIG. 4 schematically shows the changes which occurred to the surface potential level of the photosensitive member 1 during the pre-rotation process when the electrical resistance of the charge roller 2 was $1\times10^6$ Ω·cm. In this case, even during the second rotation of the photosensitive member 1, the surface potential level of the photosensitive member 1 did not converge to the target level. It was during the third rotation of the photosensitive member 1 that the peripheral surface of the photosensitive member 1 was uniformly charged to the target level. In this case, the exposing process should be started after the surface potential level of the photosensitive member 1 has become stable, at the preset level, in surface potential level during the third rotation of the photosensitive member 1 after the starting of the process for charging the photosensitive member 1. Therefore, the length of time required for the pre-rotation process is equivalent to the sum of at least twice the circumference of the photosensitive member 1, and the distance between the charging position X1 to the exposing position X2 (FIG. 10 which will be described later).

Thus, it is possible to set the amount (length) of the pre-rotation process in consideration of the situation in which the photosensitive member 1 has to be rotated three times during the pre-rotation process to ensure that the peripheral surface of the photosensitive member 1 is properly charged, as shown in FIG. 4, in order to prevent the image forming apparatus 100 from outputting images which are abnormal (nonuniform) in density. In such a case, however, it is possible that even though the photosensitive member 1 was satisfactorily charged during the second rotation of the photosensitive member 1, the photosensitive member 1 will be rotated once more (for the third time), although this depends on the cumulative usage (electrical resistance) of the charge roller 2. From the standpoint of the productivity of the image forming apparatus 100 and the longevity of the service life of the photosensitive member 1, this additional (unnecessary) rotation of the photosensitive member 1 is desired to be as short as possible.

In this embodiment, therefore, the optimal amount (length) of time the photosensitive member 1 is to be rotated during the pre-rotation process is estimated as will be described next, and the pre-rotation process is controlled according to the estimation.

4. Pre-Rotation Process Control

To begin with, the relationship between the surface potential level of the photosensitive member 1 and charge current (DC) is described.

As the portion of the peripheral surface of the photosensitive member 1, which has been uniformly charged to the preset potential level Vd by the charge roller 2, passes by the transferring section T1, it is discharged by the primary transfer roller 5. Consequently, its surface potential level changes to the post-transfer level Vt (which in this embodiment is −300 V when transfer current is 20 μA; Vt=−300 V). In a case where the photosensitive member 1 is uniformly charged by the charge roller 2, with the potential level of the photosensitive member 1 remaining at the level Vt, the contrast ΔV [V] is: $\Delta V=|Vd-Vt|$.

In a case where the photosensitive member 1 fails to be uniformly charged to the preset potential level Vd even during the second rotation of the photosensitive member 1, the surface potential level of the photosensitive member 1 becomes Vd(n), and the contrast ΔV(n) [V] is: $\Delta V(n)=|\Delta d(n)-Vt|$. The amounts of the direct currents Idc and Idc(n) which flow during this charging process when the contrasts are ΔV and ΔV(n), are obtainable from the following equations (1) and (2), respectively. It is assumed here that the dimension of the photosensitive member 1 in terms of the lengthwise direction of the photosensitive member 1 (more precisely, dimension of area of contact between photosensitive member 1 and charge roller 2) is L [m]; the speed (peripheral velocity) of the photosensitive member 1 is v [m/s]; the thickness (more precisely, thickness of combination of layers on electrically conductive supporting member 1*a*) of the photosensitive member 1; the specific inductive capacity of the photosensitive member 1 (more specifically, combination of layers on electrically conductive supporting member 1*a*) is ∈; and the dielectric constant of vacuum is ∈0.

$$Idc=\in\times\in 0\times L\times v\times\Delta V/d \quad (1)$$

$$Idc(n)=\in\times\in 0\times L\times v\times\Delta V(n)/d \quad (2)$$

The dimension L and speed v of the photosensitive member 1 are preset, and the film thickness d of the photosensitive member 1 can be fairly accurately calculated based on the cumulative length of time the photosensitive member 1 was charged, and the cumulative length of time the photosensitive member 1 was rotated.

Thus, the relationship between the amount of the direct current Idc when the potential level of the peripheral surface of the photosensitive member 1 is uniform at the preset level, and the amount of direct current Idc(n) when the potential level of the peripheral surface of the photosensitive member 1 is not uniform at the preset level, is as follows:

$$Idc(n)=\Delta V(n)/\Delta V(n)/\Delta V\times Idc.$$

That is, the changes which occur to the surface potential level of the photosensitive member 1 before the photosensitive member 1 will have not been uniformly charged to the preset potential level can be estimated by detecting the amount of the charge current (DC).

Next, the relationship between the charge current (DC) and the amount (length) of the pre-rotation process is described.

Figure 5:
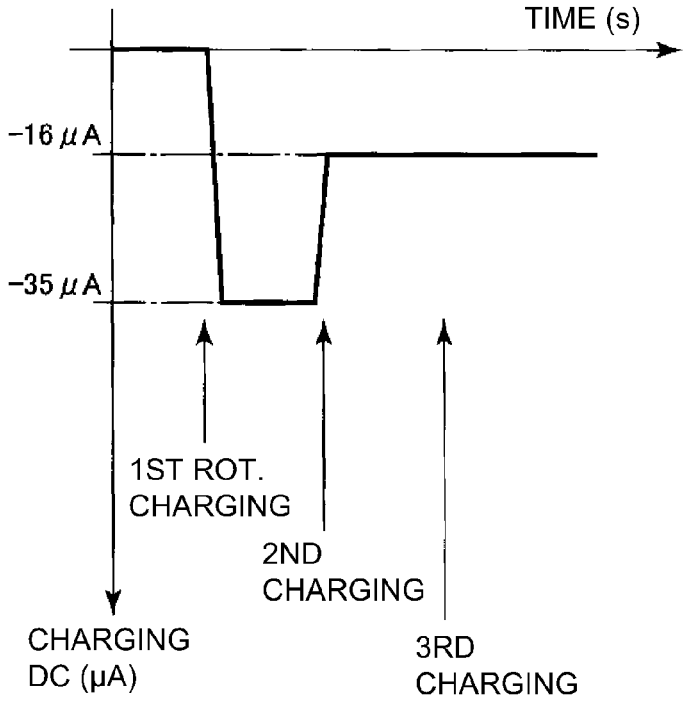
FIG. 5 is a schematic drawing for showing the differences among the amounts of the direct current which flows during the first, second, and third rotations of the photosensitive drum in the normal environment.

Shown in FIG. 5 are the changes which occurred to the charge current (DC) when the electrical resistance of the charge roller 2 was roughly $1\times10^5$ Ω·cm (condition shown in above-described FIG. 4). During this process, the transfer current was 20 μA; the speed v of the photosensitive member 1 was 120 mm/sec; and the film thickness d was 17 μm. In this case, the charge current (DC) was −35 μA during the first rotation of the photosensitive member 1, whereas it was −16 μA during the second rotation of the photosensitive member 1, for the following reason. That is, in a case where the photosensitive member 1 began to be charged during its first rotation, the surface potential level of the photosensitive member 1 was 0 V, whereas in a case where the photosensitive member 1 began to be charged during its second rotation and thereafter, the potential level of the peripheral surface of the photosensitive member 1 was the difference between the potential level to which the peripheral surface of the photosensitive member 1 was charged during the immediately preceding rotation of the photosensitive member 1 and the amount by which the potential level of the peripheral surface of the photosensitive member 1 was reduced by the electrical discharge to which the peripheral surface of the photosensitive member 1 was subjected while it was made to pass by the transfer position T1.

Figure 6:
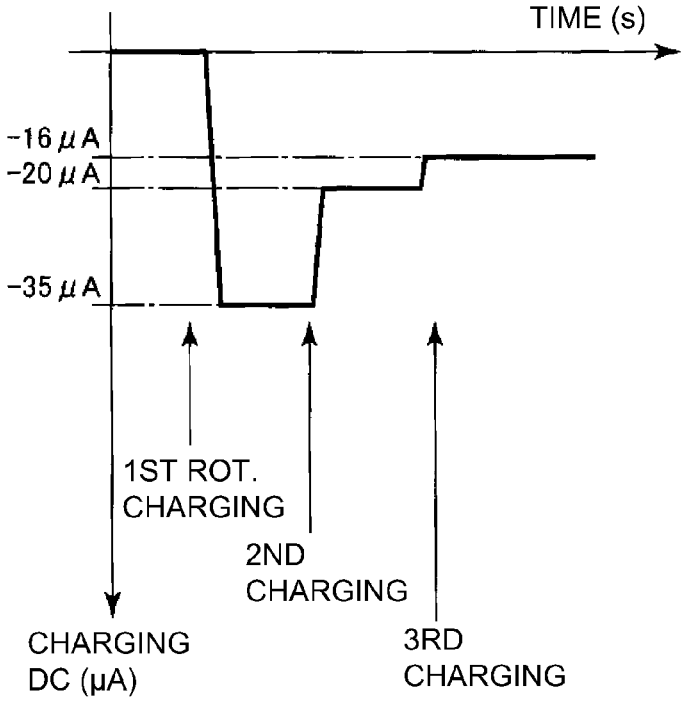
FIG. 6 is a schematic drawing of the difference among the amounts of the direct current which flows during the first, second, and third rotations of the photosensitive drum in the low humidity environment.

Shown in FIG. 6 are the changes which occurred to the charge current (DC) when the electrical resistance of the charge roller 2 was roughly $1\times10^6$ Ω·cm (condition shown in above-described FIG. 4). Also during this process, the transfer current was 20 μA; the speed v of the photosensitive member 1 was 120 mm/sec; and the film thickness d was 17 μm. In this case, the charge current (DC) was smaller during the third rotation of the photosensitive member 1 and thereafter than during the first rotation of the photosensitive member 1, for the same reason as the one given above. However, there was the difference in the amount of the charge current (DC) between the second and third rotations of the photosensitive member 1 (−20 μA during second rotation, and −16 μA during third rotation). This difference occurred because even during the second rotation of the photosensitive member 1, the surface potential of the photosensitive member 1 did not converge to the target level.

Thus, the charge current (DC) which flows to the photosensitive member 1 during the pre-rotation process is detected. Then, the charge current (DC) which flows to the photosensitive member 1 when the potential of the peripheral surface of the photosensitive member 1 is uniform at the preset level Vd is compared with the charge current (DC) which flows to the photosensitive member 1 during the second rotation of the photosensitive member 1. Based on this comparison, it is possible to estimate the difference in the surface potential level of the photosensitive member 1 between the second and third rotations of the photosensitive member 1. That is, in a case where the difference between the charge current (DC) detected during the second rotation of the photosensitive member photosensitive member 1 and the charge current (DC) which flows when the potential of the peripheral surface of the photosensitive member 1 is uniform at the preset level is no more than a preset threshold value, it may be determined that the photosensitive member 1 failed to be uniformly charged to the preset level Vd during its second rotation. In such a case, the pre-rotation process is to be extended by a length which is equivalent to one full rotation, for example, of the photosensitive member 1, in order to prevent the image forming apparatus 100 from outputting images which are abnormal (nonuniform) in density.

Figure 7:
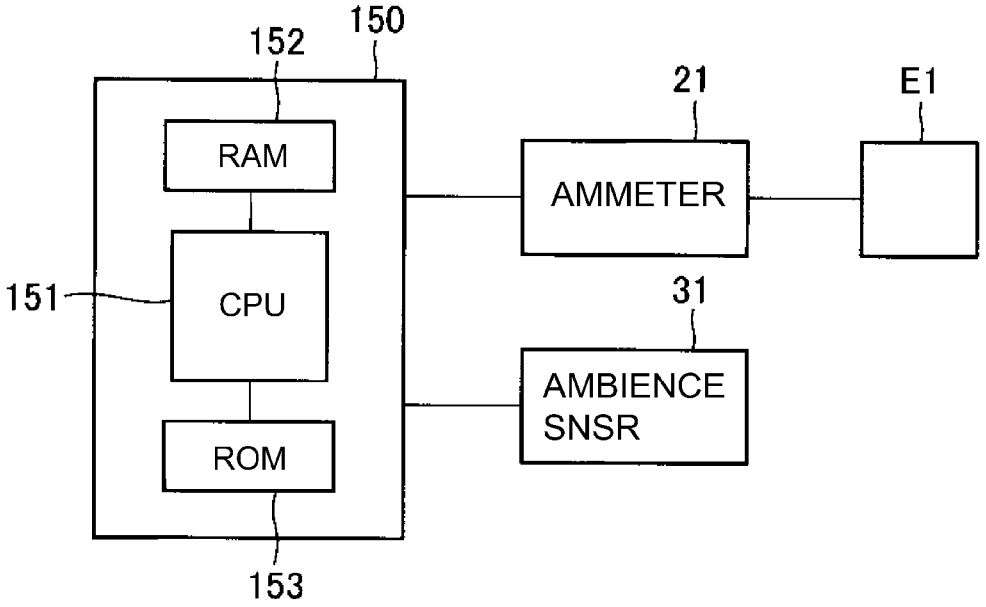
FIG. 7 is a block diagram of the pre-rotation control system.
Figure 8:
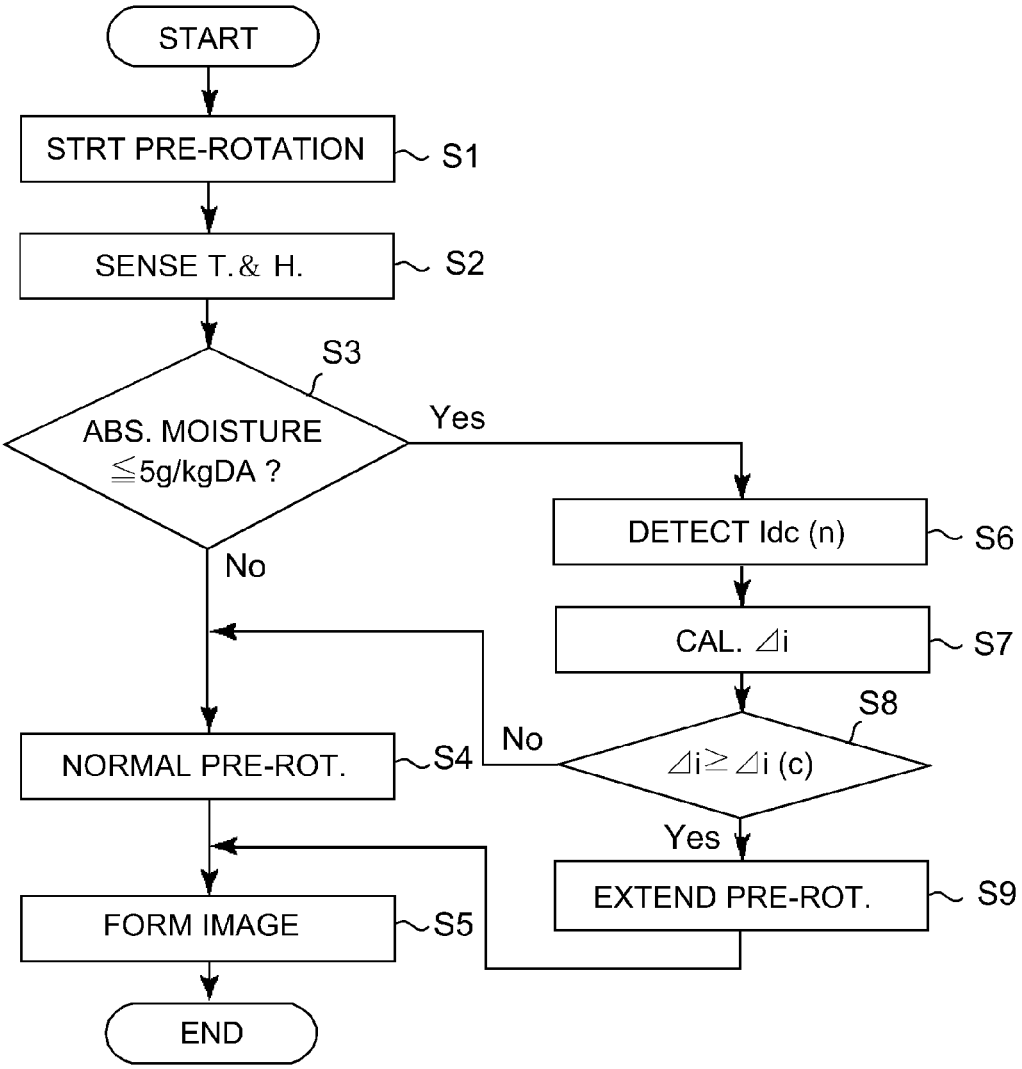
FIG. 8 is a flowchart of the pre-rotation control sequence.

Next, an example of actual procedure for controlling the pre-rotation process is described. FIG. 7 is a block diagram of the pre-rotation process control in this embodiment. It shows the general procedure of the control. FIG. 8 is a flowchart of the pre-rotation process control. It shows the general procedure of the control.

In this embodiment, the pre-rotation process control is carried out by a control section 150, as a controlling means, with which the image forming apparatus 100 is provided. The control section 150 has: a CPU 151, as a central element of the control section 150, which is in charge of various computations; a RAM 152 which is a storage element; a ROM 153; etc. In the RAM 152, the results of the detection by the sensors are stored. In the ROM 153, control programs, data tables obtained in advance, etc., are stored. The control section 150 is in connection to various sections of the image forming apparatus 100 which are to be controlled by the control section 150. In particular, in this embodiment, the control section 150 is in connection to the ammeter 21 (current detection circuit), the temperature-humidity sensor 31, which is an environment sensor as an environment detecting means, and the like. In this embodiment, the temperature-humidity sensor 31 detects the ambient temperature and humidity of the image forming apparatus 100. Also in this embodiment, the control section 150 functions as a section for calculating an absolute humidity (absolute amount of moisture), which is described later, a section for calculating the amount of the above-described difference in charge current, and a section for controlling the pre-rotation process sequence.

As a job is started, the control section 150 starts the pre-rotation process sequence (S1). Then, the control section 150 reads the temperature and humidity detected by the temperature-humidity sensor 31 (S2). Next, the control section 150 functions as the section for calculating the absolute humidity. That is, it calculates the absolute amount of moisture based on the detected temperature and humidity, and determines whether or not the calculated absolute amount of moisture is no more than a preset value, which in this embodiment was 5.0 k/kgDryair (amount of moisture per 1 kg of dry air) (S3). If the control section 150 determines in S3 that the absolute amount of moisture is greater than 5.0 g/kgDryAir (No in S3), the control section 150 functions as the pre-rotation process controlling section, and makes the image forming apparatus 100 perform the normal pre-rotation sequence (S4). Then, as the pre-rotation process ends, the control section 150 makes the image forming apparatus 100 starts image formation (S5).

FIG. 9 is a timing chart of the normal pre-rotation sequence in this embodiment. Shown in FIG. 9 are the timing with which the exposing device 3 is turned on for exposure, or turned off, the timing with which the charge bias is turned on or off, the timing with which the development bias is turned on or off, and the timing with which the primary transfer bias is turned on or off. As is evident from FIG. 9, the normal pre-rotation sequence in this embodiment is carried out for a length of time which is proportional to the sum of the circumference of the photosensitive member 1 and the distance from the charging position X1 to the exposing position X2.

If it is determined that the absolute humidity is no more than 5.0 g/kgDryAir in S3 in FIG. 8 (Yes in S3), the control section 150 makes the temperature-humidity sensor 31 detect the amount Idc(n) of the charge current (DC) (S6). Then, the control section 150 functions as the section for calculating the difference 1*i* in current amount difference based on the amount of the direct current Idc(n) detected by the ammeter 21 in S6, and stores the calculated current amount difference in the RAM 152 (S7). During this process, the control section 150 obtains the difference between the detected amount Idc (n) of the charge current (DC), and a referential value Idc which is equivalent to the amount of the charge current (DC), which will be detected by the ammeter 21 if the peripheral surface of the photosensitive member 1 is uniform in potential level at the preset level Vdc. In this embodiment, the amount of the charge current (DC) detected by the ammeter 21 during the image formation (electric static latent image formation) in preceding job is used as this referential value. In particular, in this embodiment, the amount of the charge current (DC) detected during the immediately preceding job is the referential value Idc. However, it does not need to be limited to the charge current (DC) detected in the immediately preceding job. It may be the amount of the charge current (DC) detected in one of the multiple preceding jobs, as long as it enables the control section 150 to estimate the state of the photosensitive member 1 and charge roller 2 in the current job, at an tolerable level of accuracy. Next, the control section 150 compares the amount Δi of the difference between the two charge currents (DC) with a value Δi(c), as a preset threshold value for the extension of the pre-rotation process, stored in advance in the ROM 153. Then, it determines whether or not the amount Δi is no more than the threshold value Δi(c) (S8). If the control section 150 determines in S8: Δi≥Δi(c) (Yes in S8), it functions as the section for controlling the pre-rotation sequence to make the image forming apparatus 100 carry out the extended pre-rotation sequence (S9). Thereafter, as soon as the extended pre-rotation sequence is completed, the control section 150 makes the image forming apparatus 100 start image formation (S5).

FIG. 10 is a timing chart of the extended pre-rotation sequence in this embodiment. FIG. 10 shows the operational timing of each of various sections, like FIG. 9. Referring to FIG. 10, the extended pre-rotation sequence in this embodiment is longer than the normal pre-rotation sequence, by the amount which is equivalent to the circumference of the photosensitive member 1. That is, the extended pre-rotation sequence in this embodiment is carried out for a length of time which is equivalent to the sum of twice the circumference of the photosensitive member 1 and the distance from the charging position X1 to the exposing position X2. The amount of the charge current (DC) is detected while the leading edge of the portion of the peripheral surface of the photosensitive member 1, which was charged during the second rotation of the photosensitive member 1, moves from the charging position X1 to the exposing position X2.

On the other hand, if the control section 150 determines in S8 in FIG. 8: Δi<Δi(c) (No in S8), it functions as the section for controlling the pre-rotation sequence to make the image forming apparatus 100 carry out the normal pre-rotation sequence (S4). Thereafter, as soon as the normal pre-rotation sequence is completed, the control section 150 makes the image forming apparatus 100 start image formation (S5). The operations carried out by various sections of the image forming apparatus 100 during the normal pre-rotation sequence are as indicated by the timing chart in FIG. 9.

As described above, it has been discovered by experiments or the like that as the amount of difference between the above-described two charge currents (DC) becomes greater than the preset threshold value, there occurs a significant amount of difference between the potential level to which the photosensitive member 1 is charged during the first rotation of the photosensitive member 1, and that in the second rotation, and therefore, the image forming apparatus 100 sometimes outputs images which are abnormal (nonuniform) in density. In this embodiment, therefore, the charge current (DC) is detected during the pre-rotation process to predict the possible occurrence of the anomaly, and the pre-rotation process is extended as necessary. Therefore, it is possible to minimize the length of time to be spent for the pre-rotation process to prevent the image forming apparatus 100 from outputting images which are abnormal (nonuniform) in density. More concretely, it has been discovered in advance by experiments or the like that in a case where the absolute ambient humidity of the image forming apparatus 100 is greater than the preset threshold value, the electrical resistance of the charge roller 2 is low enough to prevent the photosensitive member 1 from being nonuniformly charged. In this embodiment, therefore, in a case where the absolute humidity of the environment in which the image forming apparatus 100 is operated is greater than the preset threshold value, the charge current (DC) is not detected during the pre-rotation process. That is, the normal pre-rotation sequence is carried out.

By the way, in this embodiment, as the referential value with which the amount of the charge current (DC) detected during the pre-rotation process is to be compared, the charge current (DC) detected during one of the preceding jobs was used. However, this embodiment is not intended to limit the present invention in scope. For example, the value which is calculated in advance with the use of the above-described equation (photosensitive member 1), or was obtained by experiments, and stored in the ROM 153, may be used as the referential value. Regarding the referential value Idc, one of the values set based on the information about the cumulative usage (cumulative length of time photosensitive member 1 has been charged, or rotated) of the photosensitive member photosensitive member 1 may be selected according to the condition in which the image forming apparatus 100 is operated. In such a case, the image forming apparatus 100 is to be equipped with a counter which renews and stores information related to the usage of the photosensitive member 1, such as the cumulative length of time the photosensitive member 1 in the image forming apparatus 100 has been charged since it was brand-new, cumulative length of time the photosensitive member 1 in the image forming apparatus 100 has been used since it was brand-new, and the like factors, so that one of the referential values Idc can be selectively used according to the information.

As described above, in this embodiment, the image forming apparatus 100 has the current detecting section 21 which detects the direct current which flows to the charge roller 2 as voltage is applied to the charge roller 2 by the charge voltage power source E1. Further, the image forming apparatus 100 has the control section 150 which controls the preparatory operation which charges the photosensitive member 1 with the use of the charge roller 2, while rotating the photosensitive member 1, before forming an electrostatic latent image on the photosensitive member 1. In the preparatory operation, the control section 150 changes the amount by which the photosensitive member 1 is rotated during the preparatory operation, based on the amount of the direct current detected by the current detecting section 21 during the preparatory operation. To describe in detail, if the amount of the direct current detected by the current detecting section 21 during the preparatory operation is smaller than the referential value, and the amount of the difference between the amount of the detected direct current and the referential value becomes no less than the preset value, the control section 150 increases the amount by which the photosensitive member 1 is rotated during the on-going preparatory operation. In this embodiment, the above-mentioned referential value is the value of the amount of the direct current detected by the current detecting section 21 while the portion of the peripheral surface of the photosensitive member 1, across which an electrostatic image was formed during one of the image forming operations carried out prior to the current preparatory operation (in particular, in this embodiment, image forming operation carried out immediately prior to current preparatory operation).

Further, in this embodiment, in a case where the results of the detection by the environment sensor 31 satisfies the preset condition, the control section 150 carries out the operation for detecting the amount of the direct current with the use of the current detecting section 21, in order to change the amount by which the photosensitive member 1 is to be rotated during the preparatory operation. In particular, in this embodiment, in a case where the absolute humidity of the ambience of the image forming apparatus 100, which is shown by the results of the detection by the environment sensor 21, is no more than the preset threshold value, the control section 150 carries out the above-described operation. Further, in particular, in this embodiment, the current detecting section 21 detects the amount of the direct current during the second rotation of the photosensitive member 1 in the preparatory operation. In a case where the control section 150 does not change the amount by which the photosensitive member 1 is rotated in the preparatory operation, it makes it possible to form an electrostatic image, starting from the portion of the peripheral surface of the photosensitive member 1, which was charged during the second rotation of the photosensitive member 1. On the other hand, in a case where the control section 150 changes the amount by which the photosensitive member 1 is to be rotated in the preparatory operation, the control section 150 makes it possible to form an electrostatic image, starting from the portion of the peripheral surface of the photosensitive member 1, which was charged during the third rotation of the photosensitive member 1.

As described above, the image forming apparatus 100 in this embodiment employs the DC-based charging method, and does not have an exposing device for discharging the photosensitive member 1. It determines the state of the photosensitive member 1 and charge roller 2 with the use of the temperature-humidity sensor 31 and ammeter 21. It carries out the pre-rotation process for an optimal amount (length of time). Therefore, it is possible to prevent the image forming apparatus 100 from outputting images which are abnormal (nonuniform) in density, while preventing time from being spent longer than necessary for the pre-rotation sequence. As described above, according to this embodiment, it is possible to reduce even the image forming apparatus 100 which is low in cost, small in size, and simple in structure, in the length of time necessary for the pre-rotation process, in the anomaly (nonuniformity) in image density, which is attributable to the nonuniformity in the surface potential of the photosensitive member 1, while preventing time from being spent longer than necessary, for the pre-rotation sequence.

[Miscellanies]

In the foregoing, the present invention was described with reference to the concrete embodiment of the present invention. However, the preceding embodiment is not intended to limit the present invention in scope.

For example, in this above-described embodiment, in the case of the pre-rotation process carried out in the normal environment (normal pre-rotation sequence), the photosensitive member was uniformly charged to the preset potential level during the second rotation of the photosensitive member. Further, in the pre-rotation process which was carried out in the low temperature-low humidity environment, and in which the preset condition was satisfied (extended pre-rotation sequence), the number of times the photosensitive member is to be rotated was extend by one. However, the number of times the photosensitive member is to be rotated, and/or the pre-rotation sequence is extended in terms of the rotation of the photosensitive member, does not need to be limited to those in the above-described embodiment. It should be set according to the structure of the image forming apparatus to which the present invention is applied.

Further, in the above-described embodiment, the information about the absolute ambient humidity which can be obtained based on the ambient temperature and humidity was used as the information about the environmental information. However, the embodiment is not intended to limit the present invention in scope. For example, in a case where the characteristics of the photosensitive member, in terms of charging of the photosensitive member by the charge roller, is known to be related to at least one of temperature and humidity, the information regarding one of temperature and humidity can be used as the information about the environmental information.

Further, in the above-described embodiment, in a case where the absolute humidity of the environment was no more than the present threshold value, a judgment was made regarding whether or not the pre-rotation sequence is to be extended. In an environment which has been known to make it necessary for the pre-rotation sequence to be extended, the control for determining whether or not the extension is necessary was not carried out to simplify the control, and also, to increase the image forming apparatus 100 in speed. However, in a case where whether or not the pre-rotation sequence is extended is determined while a given point of the peripheral surface of the photosensitive member moves from the charging position to the exposing position, and/or in a case where the amount by which the photosensitive member needs to be rotated for the determination is acceptably small, it may be determined with no regard to the environment.

Further, in the above-described embodiment, the charge roller was in contact with the photosensitive member. However, it is not mandatory for the charging member such as the charge roller to be in contact with the peripheral surface of the photosensitive member as a member to be charged. That is, the charging member does not need to be in contact with the photosensitive member, as long as the distance between the charge roller and photosensitive member is small enough, for example, several tens of micrometers, for electrical discharge to occur between the two members. In other words, the present invention is also applicable to an image forming apparatus structured so that the charge roller is not in contact (virtually in contact) with the photosensitive member, and the photosensitive member is charged by the electrical discharge which occurs through the gap between the charge roller and photosensitive member, in the area (which corresponds to the gaps between two components, on the immediately upstream and downstream sides of area of contact between two components in above-described embodiment).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-205221 filed on Oct. 3, 2014, which is hereby incorporated by reference herein in its entirety.

What is claimed is:

1. An image forming apparatus comprising:

a rotatable photosensitive member;

a charging member configured to charge said photosensitive member by being supplied with a DC voltage;

an image forming station configured to form an image on said photosensitive member charged by said charging member to form an electrostatic image;

a current detector configured to detect a DC current flowing to said charging member when said charging member is supplied with the DC voltage from a voltage source;

an executing portion configured to execute pre-charging operation for charging, by said charging member, said photosensitive member which is rotating, after production of an image formation signal prior to image forming operation by said image forming station; and a controller configured to control an amount of rotation of said photosensitive member in the pre-charging operation on the basis of the DC current detected by said current detector during the pre-charging operation.

2. An apparatus according to claim 1, wherein said controller increases the amount of the rotation of said photosensitive member in the pre-charging operation when the DC current detected by said current detector during the pre-charging operation decreases to be lower than a reference value to such an extent that a difference from the reference value becomes larger than a predetermined threshold.

3. An apparatus according to claim 2, wherein the reference value is the DC current detected by said current detector in an image forming operation carried out before the production of a current image formation signal.

4. An apparatus according to claim 1, further comprising an ambient condition sensor configured to detect at least one of an ambient temperature and an ambient humidity, wherein said controller controls, when an absolute water content determined on the basis of a output of said ambient condition sensor is not more than a predetermined threshold, the amount of rotation of said photosensitive member in the pre-charging operation on the basis of the DC current detected by said current detector after the production of the image formation signal.

5. An apparatus according to claim 1, wherein said current detector detects the DC current during the charging operation in a second turn of the rotation of said photosensitive member, and when the amount of the rotation in the pre-charging operation is not changed, the image forming operation is enabled from such a portion of the photosensitive member that is charged in the second turn of the rotation, and when the amount of the rotation in the pre-charging operation is changed, the image forming operation is enabled from such a portion of the photosensitive member that is charged in a third turn of the rotation.

* * * * *